US011512920B1

(12) United States Patent
Oglesby

(10) Patent No.: US 11,512,920 B1
(45) Date of Patent: Nov. 29, 2022

(54) AMBIDEXTROUS BOLT CATCH FOR A LOWER RECEIVER

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 17/313,069

(22) Filed: May 6, 2021

Related U.S. Application Data

(60) Provisional application No. 63/021,205, filed on May 7, 2020.

(51) Int. Cl.
*F41A 35/06* (2006.01)
*F41A 17/42* (2006.01)
*F41A 17/36* (2006.01)

(52) U.S. Cl.
CPC ..... *F41A 35/06* (2013.01); *F41A 17/36* (2013.01); *F41A 17/42* (2013.01)

(58) Field of Classification Search
CPC ..... F41A 17/36; F41A 17/42
See application file for complete search history.

(56) References Cited

U.S. PATENT DOCUMENTS 7,661,219 B1 * 2/2010 Knight, Jr. ..... F41A 3/42 89/138
8,359,966 B1 * 1/2013 Brotherton ..... F41A 17/36 89/181
9,651,328 B1 * 5/2017 Oglesby ..... F41A 35/06
9,810,493 B2 * 11/2017 Fluhr ..... F41A 3/66
2010/0275485 A1 * 11/2010 Findlay ..... F41A 35/06 42/16
2012/0167424 A1 * 7/2012 Gomez ..... F41A 35/06 42/14
2015/0323271 A1 * 11/2015 McGinty ..... F41A 17/38 42/17
2017/0234638 A1 * 8/2017 Noonan ..... F41A 17/36 89/138
2017/0284761 A1 * 10/2017 Lewis ..... F41A 3/66
2019/0093978 A1 * 3/2019 Maugham ..... F41A 17/36
2021/0180900 A1 * 6/2021 Markut ..... F41A 3/72
2021/0270551 A1 * 9/2021 Underwood ..... F41A 17/36

* cited by examiner

*Primary Examiner* — Gabriel J. Klein
(74) *Attorney, Agent, or Firm* — Shaddock Law Group, PC

(57) ABSTRACT

An ambidextrous bolt catch having at least some of a bolt release lever having a bolt release projection, wherein the bolt release lever is rotatable between an engaged position and a disengaged position; and a bolt catch having a bolt catch recess, wherein at least a portion of the bolt release projection is received within at least a portion of the bolt catch recess, wherein the bolt catch is rotatable between an engaged position and a disengaged position, and wherein rotational movement of the bolt release lever produces rotational movement of the bolt catch, via interaction of at least a portion of the bolt release projection and at least a portion of the bolt catch recess.

17 Claims, 21 Drawing Sheets

AMBIDEXTROUS BOLT CATCH FOR A LOWER RECEIVER

CROSS-REFERENCE TO RELATED APPLICATIONS

This patent application claims the benefit of U.S. Patent Application Ser. No. 63/021,205, filed May 7, 2020, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an ambidextrous lower receiver and an ambidextrous bolt catch system adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms, include a pushbutton magazine release found on one side of the firearm—typically the right side. Oftentimes, the magazine release button is at least partially protected by one or more ridges that reduce the chances of inadvertent activation.

The magazine release button is typically attached or coupled to a magazine release, which includes a magazine engagement projection that releasably engages a portion of a magazine, when the magazine is fully inserted within the magazine well of the firearm.

The magazine release includes a magazine release connection shaft that extends from one side of the magazine release. The magazine release connection shaft includes a threaded portion that can be threaded late engaged with the threaded aperture of the magazine release button.

A magazine release spring typically provides spring biasing to the magazine release lever, when installed in the firearm.

The bolt catch is typically pivotably attached or coupled to the lower receiver on a left side, opposite the magazine release button. The bolt catch includes a bolt catch button that can be pressed to pivot the bolt catch about a bolt catch pivot aperture to pivot the bolt catch from a bolt engagement position to a bolt release position. The bolt catch is typically spring biased to the bolt release position.

In the bolt engagement position, the bolt catch is pivoted such that at least a portion of a bolt engagement projection extends in front of the face of the bolt carrier (when the bolt carrier is in a rearward position) and engages the bolt face to maintain the bolt carrier in the rearward position.

A magazine biasing projection extends from the so as to interact with a follower in a magazine. In this manner, when an empty magazine is in the firearm, the magazine follower interacts with the magazine biasing projection, to pivot the bolt catch to a bolt engagement position.

When the bolt catch button is depressed, the bolt catch pivots such that the bolt engagement projection is urged downward, away from the face of the bolt carrier, allowing the bolt carrier to move forward.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the standard bolt catch can only be operated from one side of the firearm and does not provide for ambidextrous manipulation. Thus, the ambidextrous bolt catch for a lower receiver, as disclosed herein, provides ambidextrous manipulation of the bolt catch through a bolt release lever positioned at least partially within the lower receiver of the firearm.

In various exemplary, non-limiting embodiments, the ambidextrous bolt catch, as disclosed herein, comprises an ambidextrous bolt catch system that includes a bolt release lever having a bolt release projection, wherein the bolt release lever is rotatable between an engaged position and a disengaged position; and a bolt catch having a bolt catch recess, wherein at least a portion of the bolt release projection is received within at least a portion of the bolt catch recess, wherein the bolt catch is rotatable between an engaged position and a disengaged position, and wherein rotational movement of the bolt release lever produces rotational movement of the bolt catch, via interaction of at least a portion of the bolt release projection and at least a portion of the bolt catch recess.

In various exemplary, nonlimiting embodiments, the bolt catch is spring biased to the disengaged position.

In various exemplary, nonlimiting embodiments, the ambidextrous bolt catch is positioned within a portion of a lower receiver.

In various exemplary, non-limiting embodiments, the ambidextrous bolt catch system, as disclosed herein, comprises a bolt release lever having a bolt release projection, wherein the bolt release lever is rotatable between an engaged position and a disengaged position; and a bolt catch having a bolt catch recess, wherein at least a portion of the bolt release projection is received within at least a portion of the bolt catch recess, wherein the bolt catch is rotatable between an engaged position and a disengaged position, and wherein rotational movement of the bolt release lever produces rotational movement of the bolt catch, via interaction of at least a portion of the bolt release projection and at least a portion of the bolt catch recess.

In various exemplary, nonlimiting embodiments, the bolt catch is spring biased to the disengaged position.

In various exemplary, nonlimiting embodiments, the ambidextrous bolt catch is positioned within a portion of a lower receiver.

In various exemplary, non-limiting embodiments, the ambidextrous bolt catch system, as disclosed herein, comprises a bolt catch, wherein a bolt catch recess is formed in a portion of the bolt catch, wherein a bolt catch pivot aperture is formed through the bolt catch, and wherein the bolt catch is at least partially rotatable, about the bolt catch pivot aperture, between an engaged position and a disengaged position; and a bolt release lever having a bolt release button portion and a bolt release projection portion, wherein a bolt release pivot aperture is formed through the bolt release lever, wherein the bolt release button portion is spaced apart from the bolt release projection portion, wherein the bolt release button portion is attached or coupled to the bolt release projection portion by a bolt release connector bar, wherein the bolt release projection portion includes a bolt release projection that extends from a portion of the bolt release projection portion, wherein the bolt release projection is formed so as to be at least partially received within at least a portion of the bolt catch recess of the bolt catch, wherein the bolt release lever is at least partially rotatable, about the bolt release pivot aperture, between an engaged position and a disengaged position, and wherein at least a portion of the bolt release projection interacts with at least a portion of the bolt catch recess such that rotational movement of said bolt release lever produces rotational movement of said bolt catch.

In various exemplary, nonlimiting embodiments, the bolt catch recess extends into the portion of the bolt catch, below a bolt engagement projection of the bolt catch.

In various exemplary, nonlimiting embodiments, the bolt catch comprises an upper bolt catch button and a lower bolt catch button and wherein the bolt catch pivot aperture is formed between the upper bolt catch button and the lower bolt catch button.

In various exemplary, nonlimiting embodiments, the bolt catch comprises an upper bolt catch button and a lower bolt catch button and wherein the bolt catch pivot aperture is formed between the upper bolt catch button and the lower bolt catch button, wherein the bolt catch is attached or coupled to a lower receiver of a firearm, via a bolt catch pivot pin positioned through the bolt catch pivot aperture, and wherein the bolt catch is at least partially rotatable, about the bolt catch pivot pin, between an engaged position wherein the lower bolt catch button is urged towards a lower receiver and a disengaged position wherein the upper bolt catch button is urged towards the lower receiver.

In various exemplary, nonlimiting embodiments, the bolt catch is biased to the disengaged position.

In various exemplary, nonlimiting embodiments, the bolt release lever is formed of an integral portion of material.

In various exemplary, nonlimiting embodiments, the bolt release lever comprises an upper bolt release button and a lower bolt release button and wherein the bolt release pivot aperture is formed between the upper bolt release button and the lower bolt release button.

In various exemplary, nonlimiting embodiments, the bolt release pivot aperture is formed through the bolt release button portion and the bolt release projection portion.

In various exemplary, nonlimiting embodiments, the bolt release lever comprises an upper bolt release button and a lower bolt release button and wherein the bolt release pivot aperture is formed between the upper bolt release button and the lower bolt release button, wherein the bolt release lever is attached or coupled to a lower receiver of a firearm, via a bolt release lever pivot pin positioned through the bolt release pivot aperture, and wherein the bolt release lever is at least partially rotatable, about the bolt release lever pivot pin, between an engaged position wherein the lower bolt release button is urged towards a lower receiver and the bolt release projection interacts with at least a portion of the bolt catch recess to urge the bolt catch to the engaged position and a disengaged position wherein the upper bolt release button is urged towards the lower receiver and the bolt release projection interacts with at least a portion of the bolt catch recess to urge the bolt catch to the disengaged position.

In various exemplary, non-limiting embodiments, the ambidextrous bolt catch system, as disclosed herein, comprises a bolt catch, wherein a bolt catch recess extends into a portion of the bolt catch, wherein a bolt catch pivot aperture is formed through the bolt catch, and wherein the bolt catch is at least partially rotatable, about the bolt catch pivot aperture; and a bolt release lever having a bolt release button portion and a bolt release projection portion, wherein the bolt release button portion is spaced apart from the bolt release projection portion, wherein the bolt release button portion is attached or coupled to the bolt release projection portion by a bolt release connector bar, wherein a bolt release pivot aperture is formed through the bolt release lever, wherein the bolt release projection portion includes a bolt release projection that extends from a portion of the bolt release projection portion, wherein the bolt release projection is formed so as to be at least partially received within at least a portion of the bolt catch recess of the bolt catch, wherein the bolt release lever is at least partially rotatable, about the bolt release pivot aperture, and wherein at least a portion of the bolt release projection interacts with at least a portion of the bolt catch recess such that rotational movement of said bolt release lever produces rotational movement of said bolt catch.

In various exemplary, non-limiting embodiments, the ambidextrous bolt catch system, as disclosed herein, comprises a bolt release lever having a bolt release projection, wherein the bolt release lever is rotatable between an engaged position and a disengaged position; and a bolt catch having a bolt catch recess, wherein at least a portion of the bolt release projection is received within at least a portion of the bolt catch recess, wherein the bolt catch is rotatable between an engaged position and a disengaged position, and wherein rotational movement of the bolt release lever produces rotational movement of the bolt catch, via interaction of at least a portion of the bolt release projection and at least a portion of the bolt catch recess.

Accordingly, the present disclosure provides an ambidextrous bolt catch system that allows a user to manipulate the bolt catch from either side of the lower receiver.

The present disclosure separately provides an ambidextrous bolt catch that allows a user to optionally manipulate the bolt catch in a known fashion.

The present disclosure separately provides an ambidextrous bolt catch that allows a user to lock the bolt back as well as send it forward in an ambidextrous fashion.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary and the present disclosure may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
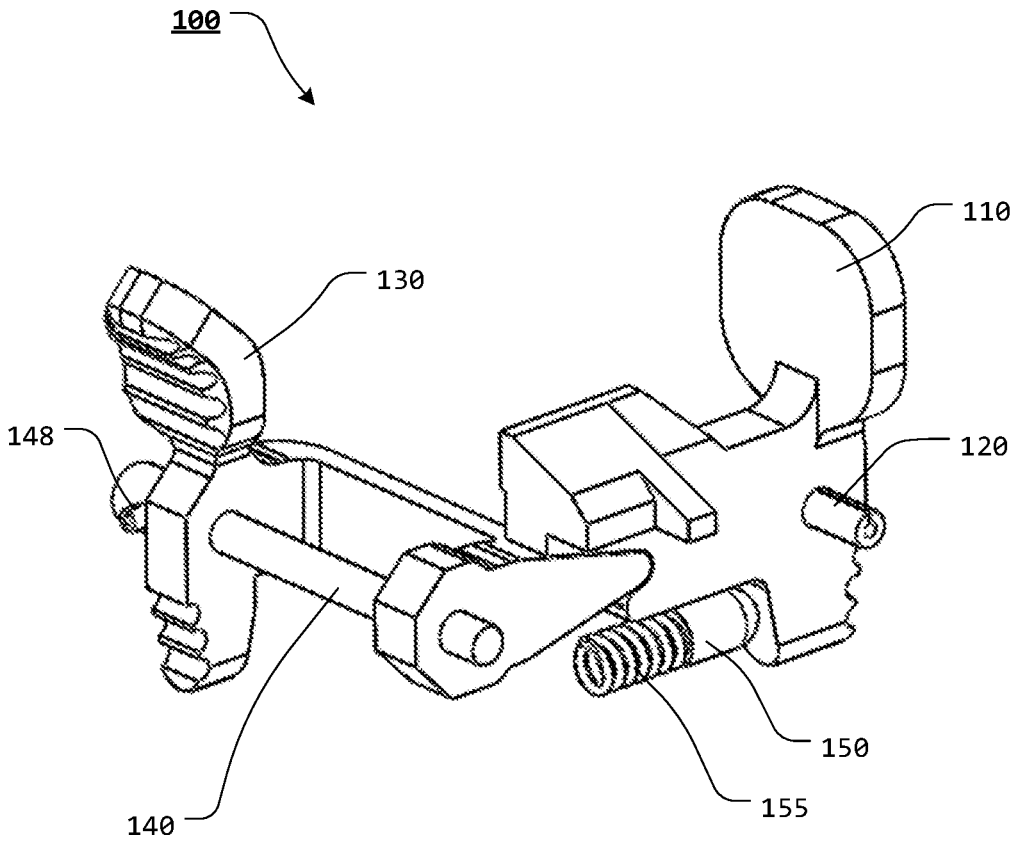
FIG. 1 illustrates a right, front perspective view of certain exemplary components of an exemplary ambidextrous bolt catch system, according to the present disclosure.
Figure 2:
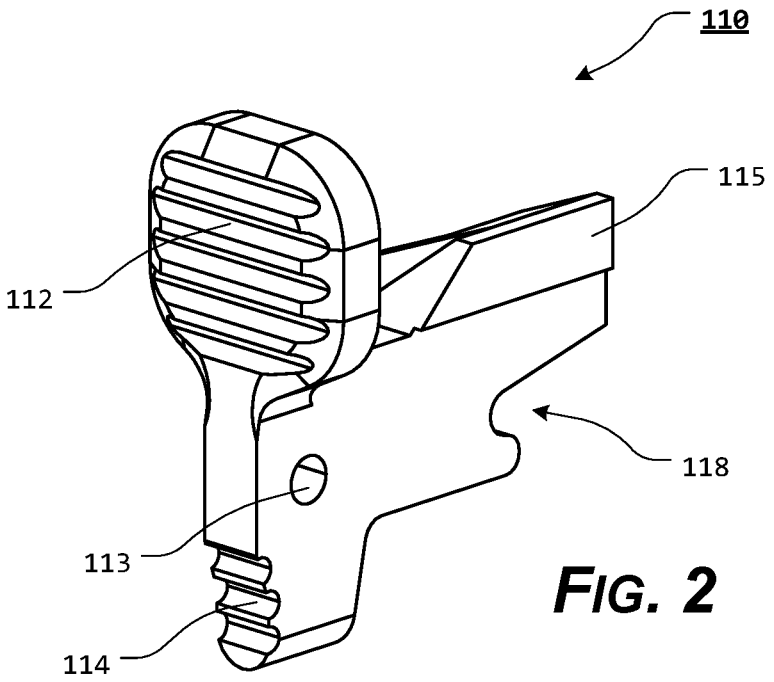
FIG. 2 illustrates an upper, rear, perspective view of an exemplary bolt catch, according to the present disclosure.
Figure 3:
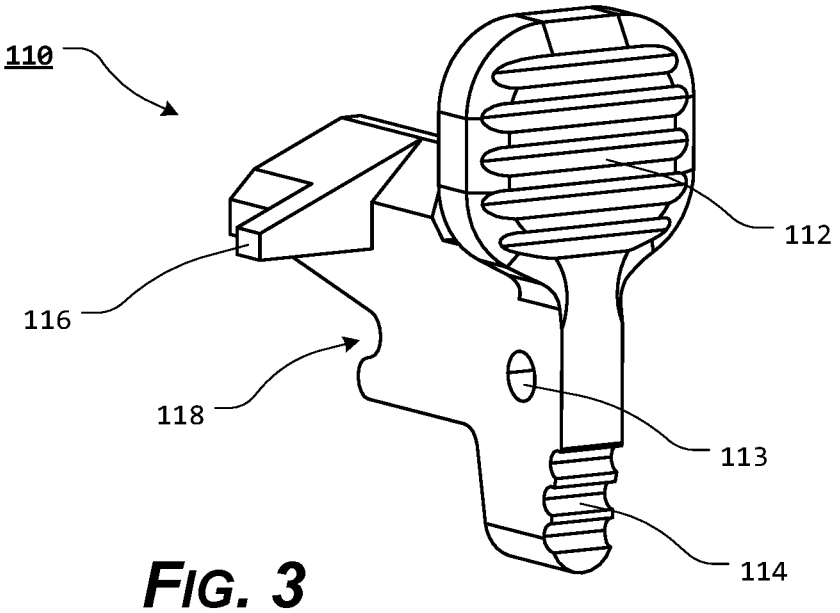
FIG. 3 illustrates an upper, front, perspective view of an exemplary bolt catch, according to the present disclosure.
Figure 4:
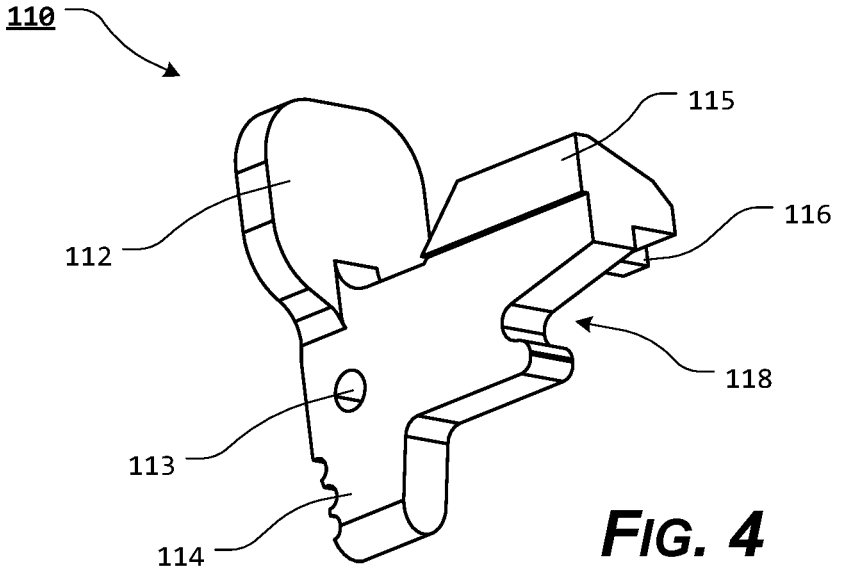
FIG. 4 illustrates a lower, rear, perspective view of an exemplary bolt catch, according to the present disclosure.
Figure 5:
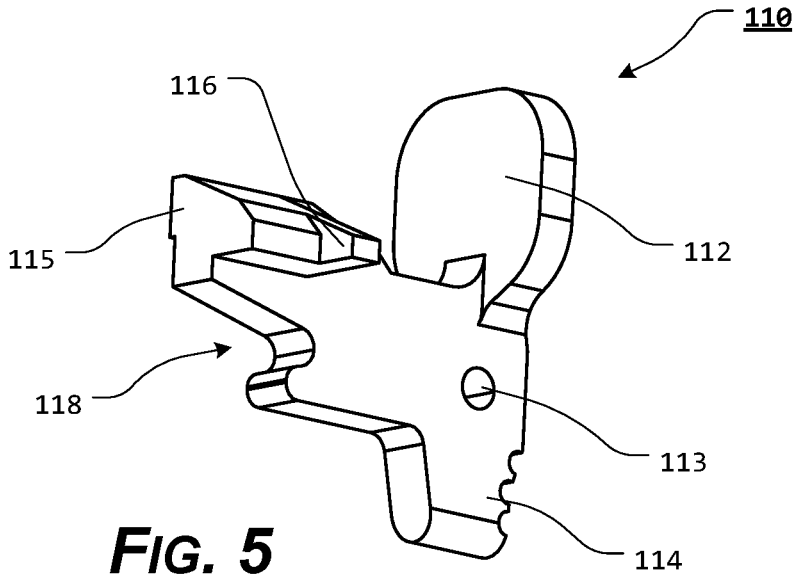
FIG. 5 illustrates a lower, front, perspective view of an exemplary bolt catch, according to the present disclosure.
Figure 6:
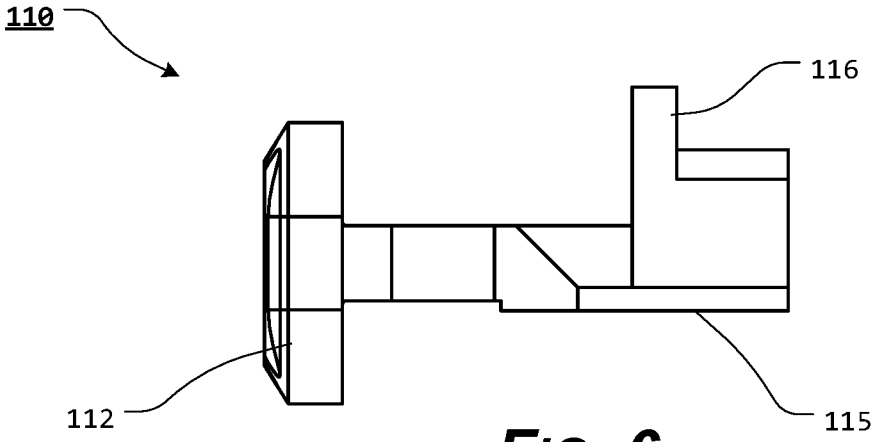
FIG. 6 illustrates a top view of an exemplary bolt catch, according to the present disclosure.
Figure 7:
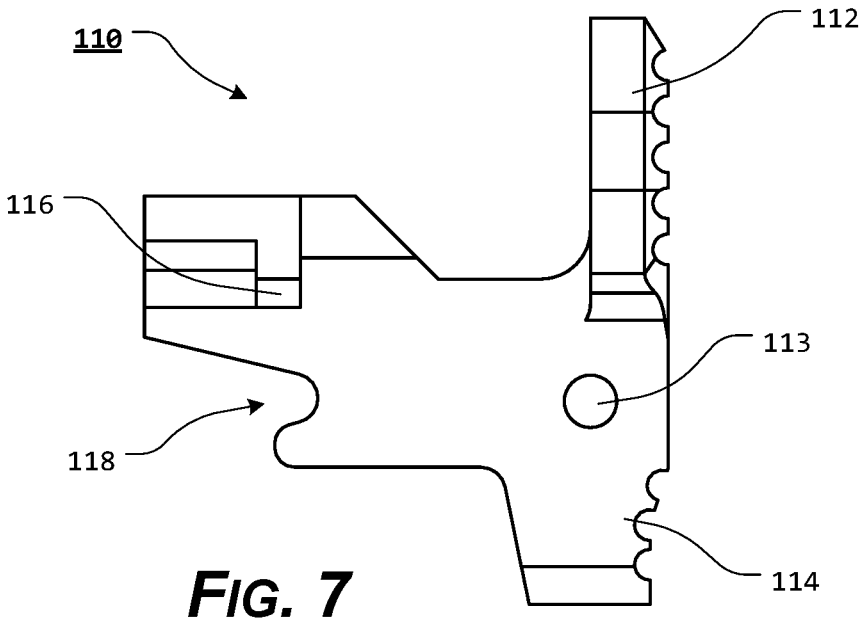
FIG. 7 illustrates a front view of an exemplary bolt catch, according to the present disclosure.
Figure 8:
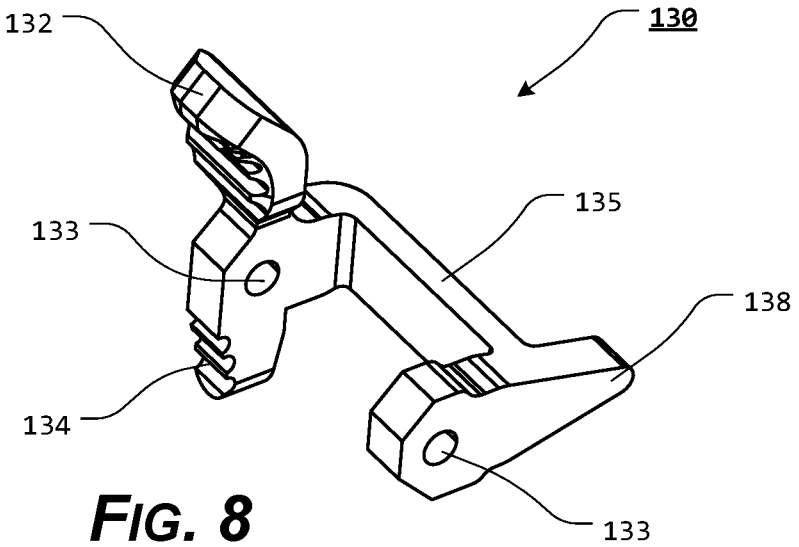
FIG. 8 illustrates an upper, front, perspective view of an exemplary bolt release lever, according to the present disclosure.
Figure 9:
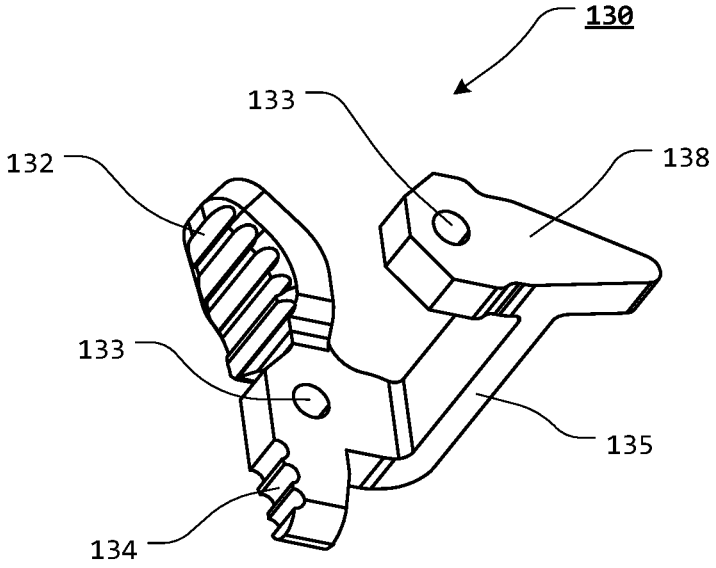
FIG. 9 illustrates a lower, front, perspective view of an exemplary bolt release lever, according to the present disclosure.
Figure 10:
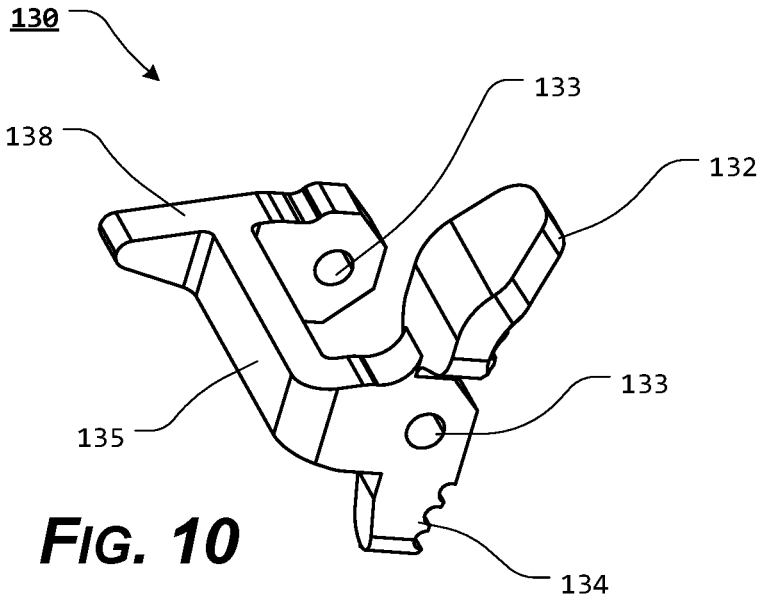
FIG. 10 illustrates an upper, rear, perspective view of an exemplary bolt release lever, according to the present disclosure.
Figure 11:
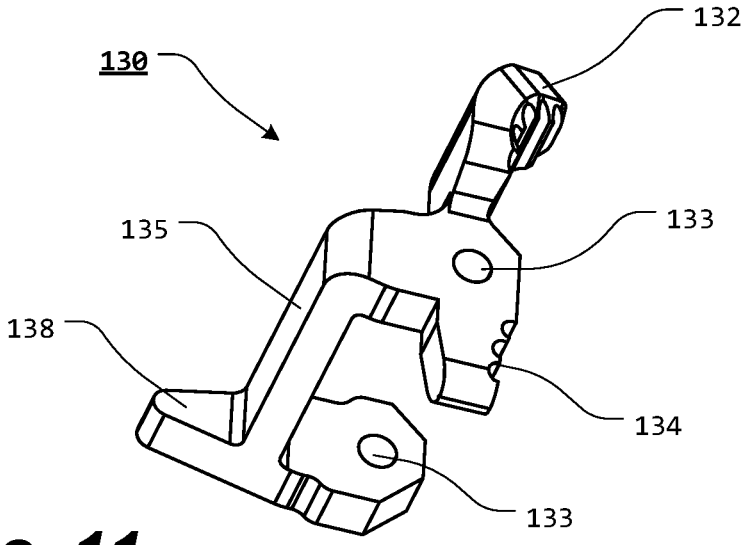
FIG. 11 illustrates a lower, rear, perspective view of an exemplary bolt release lever, according to the present disclosure.
Figure 12:
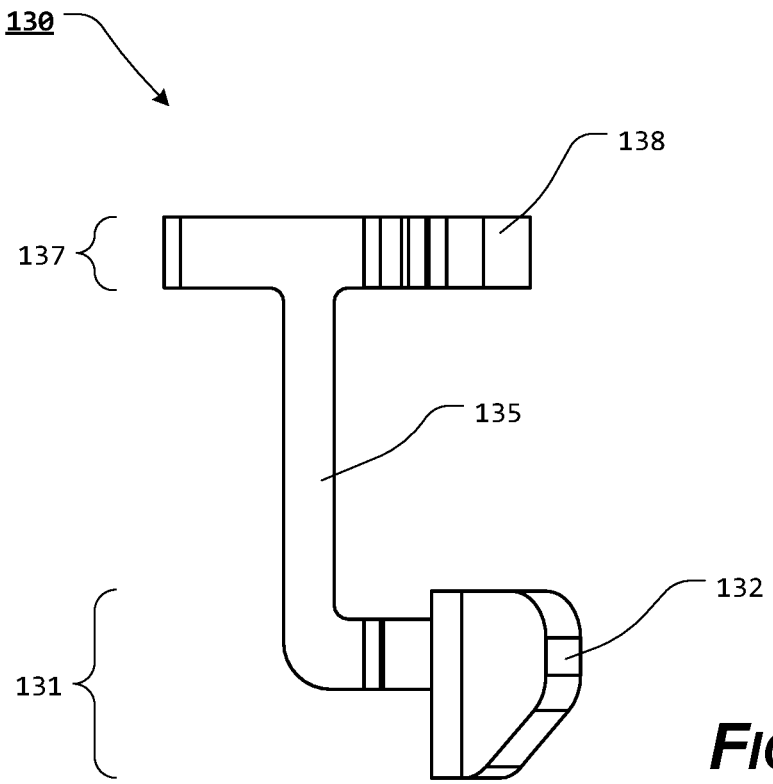
FIG. 12 illustrates a top view of an exemplary bolt release lever, according to the present disclosure.
Figure 13:
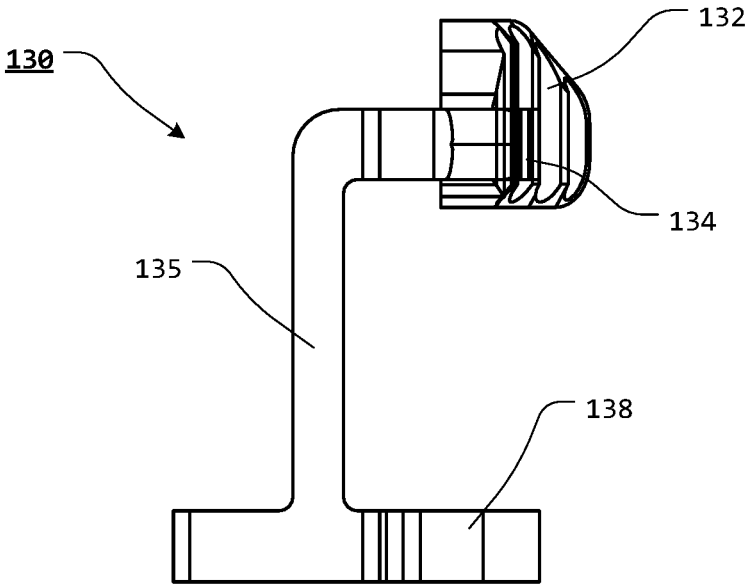
FIG. 13 illustrates a bottom view of an exemplary bolt release lever, according to the present disclosure.
Figure 14:
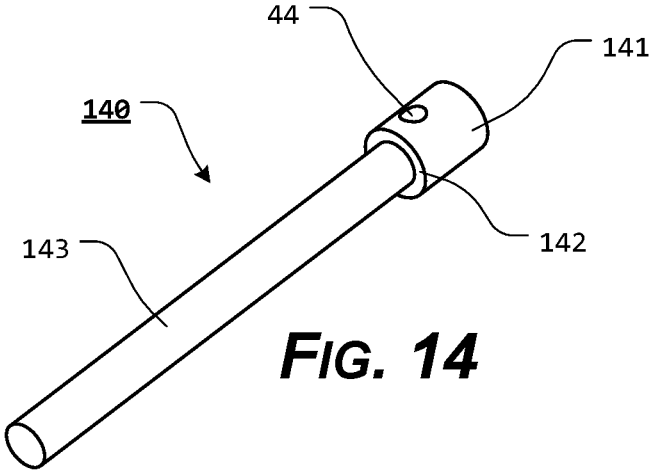
FIG. 14 illustrates a perspective view of an exemplary bolt release lever pivot pin, according to the present disclosure.
Figure 15:
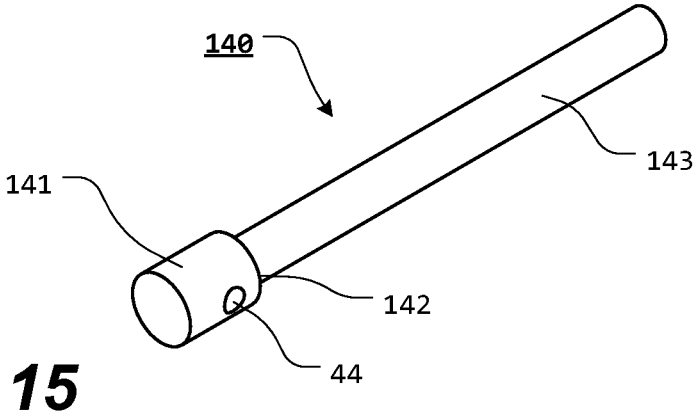
FIG. 15 illustrates a perspective view of an exemplary bolt release lever pivot pin, according to the present disclosure.
Figure 16:
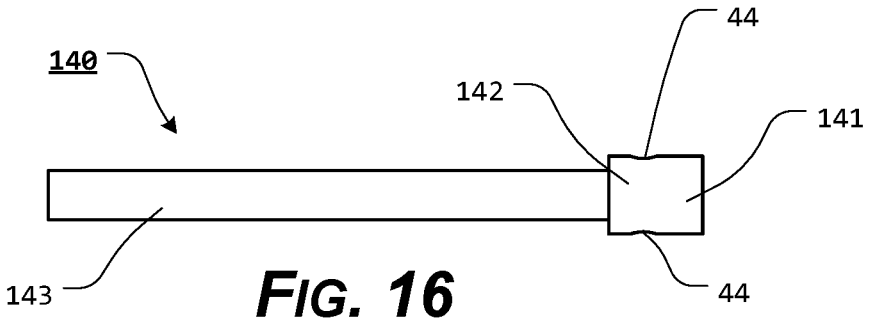
FIG. 16 illustrates a top view of an exemplary bolt release lever pivot pin, according to the present disclosure.
Figure 17:
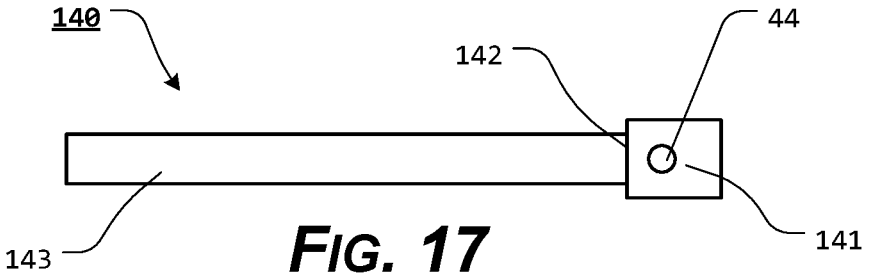
FIG. 17 illustrates a side view of an exemplary bolt release lever pivot pin, according to the present disclosure.

For simplicity and clarification, the design factors and operating principles of the ambidextrous bolt catch system according to the present disclosure are explained with reference to various exemplary embodiments of an ambidextrous bolt catch system according to the present disclosure. The basic explanation of the design factors and operating principles of the ambidextrous bolt catch system is applicable for the understanding, design, and operation of the ambidextrous bolt catch system of the presently disclosed systems, methods, and/or apparatuses. It should be appreciated that the ambidextrous bolt catch system can be adapted to many applications where an ambidextrous bolt catch system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, device, and/or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

It should also be appreciated that, for simplicity and clarification, the embodiments of the present disclosure will be described using the terms "right" and "left". However, it should be understood that these terms are merely used to aid in understanding of the present disclosure are not to be construed as limiting the systems, methods, devices, and/or apparatuses of the present disclosure. Thus, it should be appreciated that the design factors and operating principles of the ambidextrous bolt catch system described herein may be used in a "mirror image" ambidextrous bolt catch system, where in the elements described as being included in or on the right side are included in or on the left side of the lower receiver. Alternatively, certain of the elements that are described as being included in or on the right side of the lower receiver may be included in or on the left side of the lower receiver, or vice versa.

It should also be appreciated that the terms "ambidextrous", "ambidextrous bolt catch", "ambidextrous bolt release", and "lower receiver" are used for basic explanation and understanding of the operation of the systems, methods, and apparatuses of this disclosure. Therefore, the terms "ambidextrous", "ambidextrous bolt catch", "ambidextrous bolt release", and "lower receiver" are not to be construed as limiting the systems, methods, and apparatuses of this disclosure.

For simplicity and clarification, the ambidextrous bolt catch system of this disclosure will be described as being used in conjunction with the upper receiver of a firearm, such as an AR-15 or M4 style rifle or carbine. However, it should be appreciated that these are merely exemplary embodiments of the ambidextrous bolt catch system and are not to be construed as limiting this disclosure.

Turning now to the drawing FIGS., FIGS. 1-32 illustrate certain elements and/or aspects of an exemplary embodiment of an ambidextrous bolt catch system 100, according to the present disclosure. As illustrated in FIGS. 1-32, the ambidextrous bolt catch system 100 comprises at least some of a bolt catch 110 and a bolt release lever 130 utilized in conjunction with a lower receiver 170.

Figure 18:
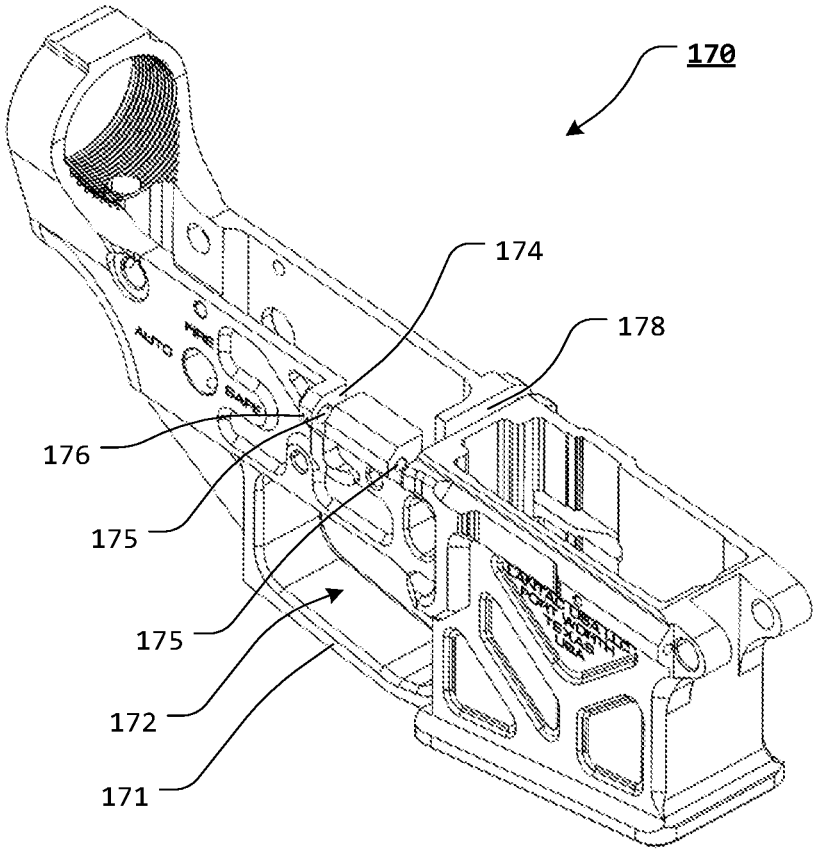
FIG. 18 illustrates an upper, right, perspective view of an exemplary lower receiver, according to the present disclosure.
Figure 19:
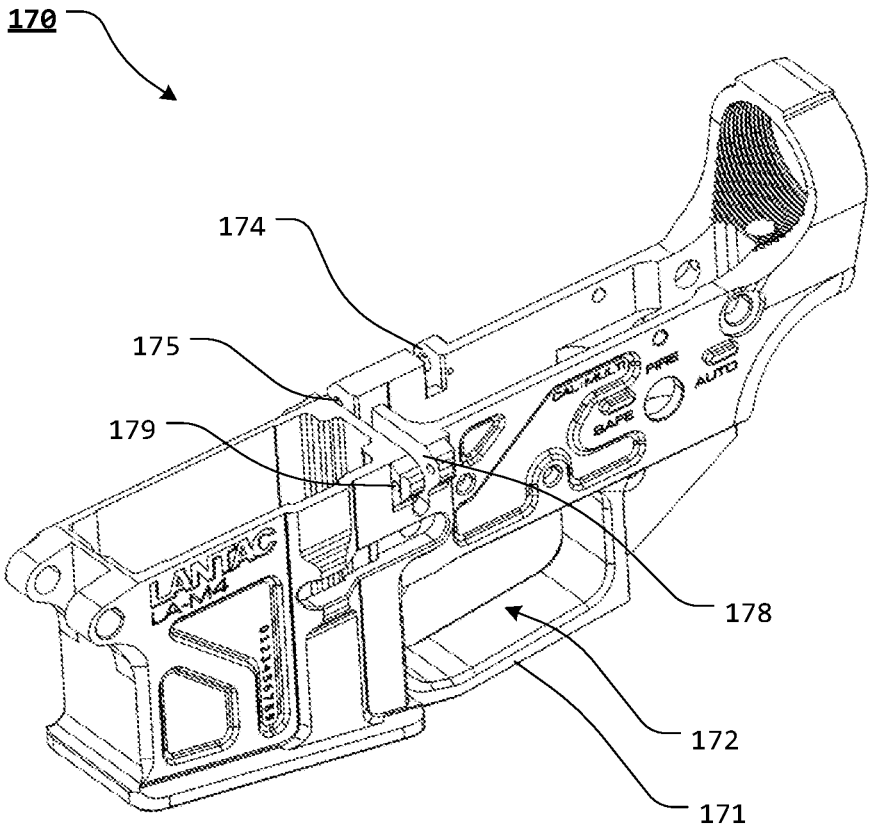
FIG. 19 illustrates an upper, left, perspective view of an exemplary lower receiver, according to the present disclosure.
Figure 20:
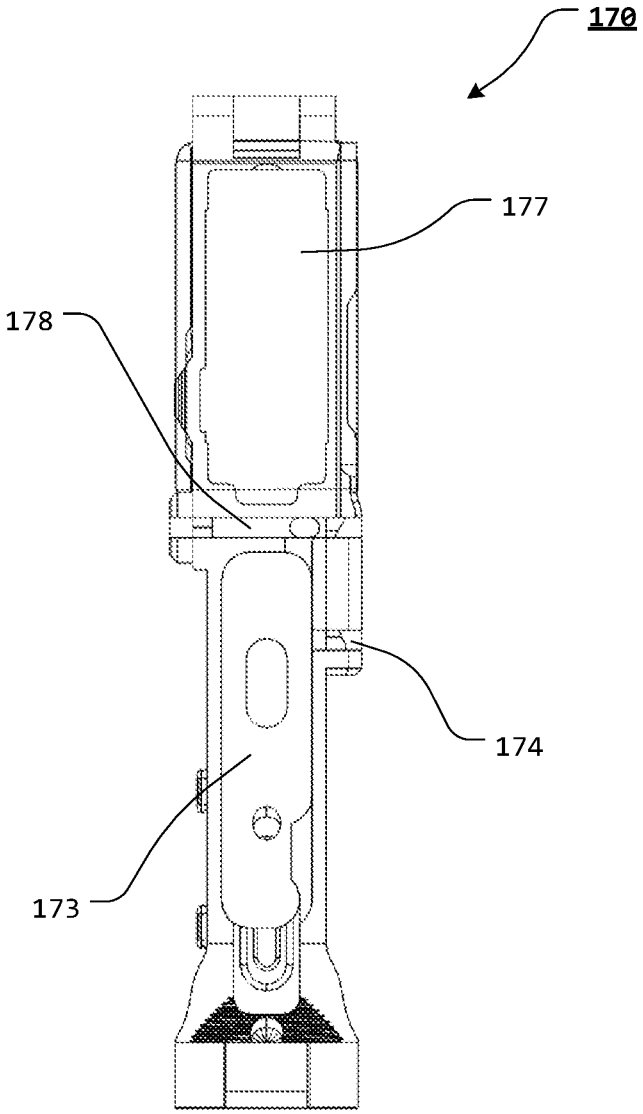
FIG. 20 illustrates a top view of an exemplary lower receiver, according to the present disclosure.
Figure 21:
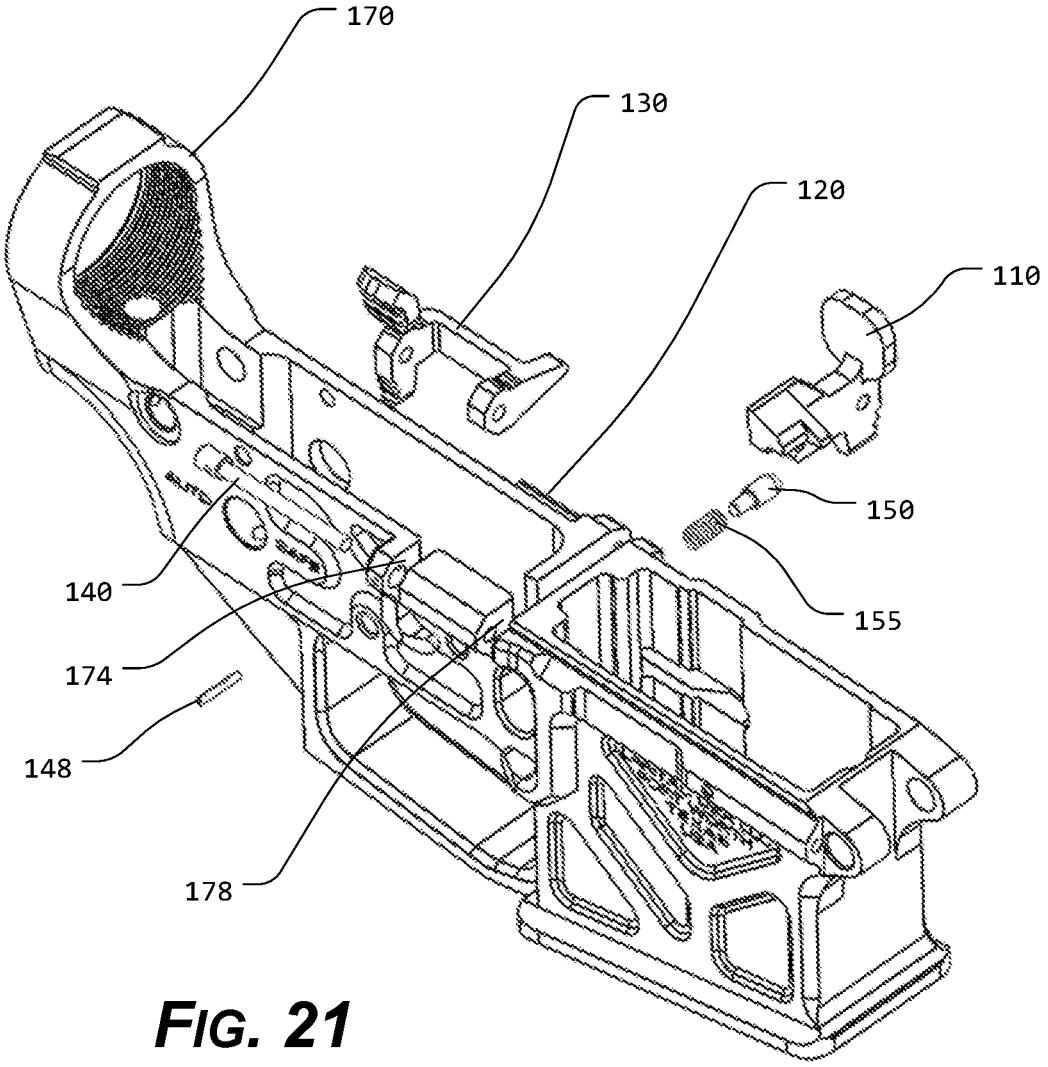
FIG. 21 illustrates an exploded upper, right, perspective view of a lower receiver with certain exemplary aligned components of an exemplary ambidextrous bolt catch system, according to the present disclosure.
Figure 22:
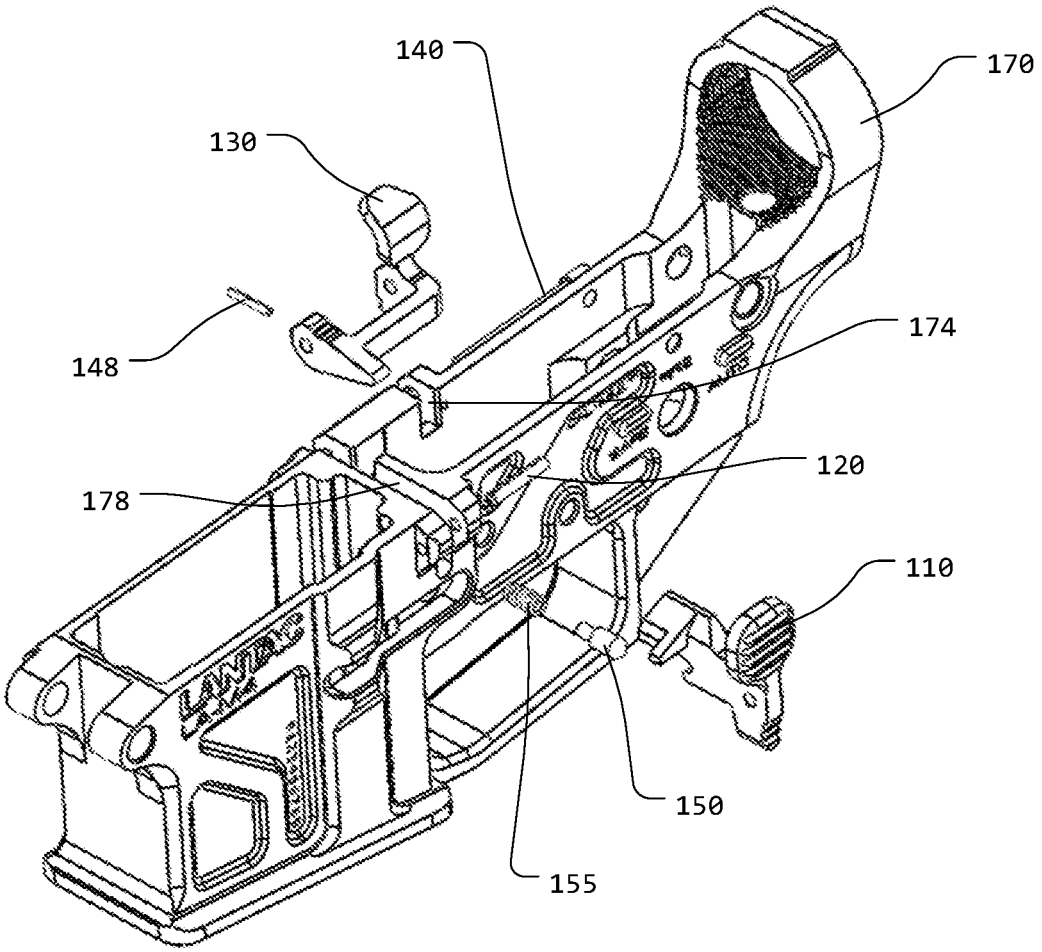
FIG. 22 illustrates an exploded upper, left, perspective view of a lower receiver with certain exemplary aligned components of an exemplary ambidextrous bolt catch system, according to the present disclosure.
Figure 23:
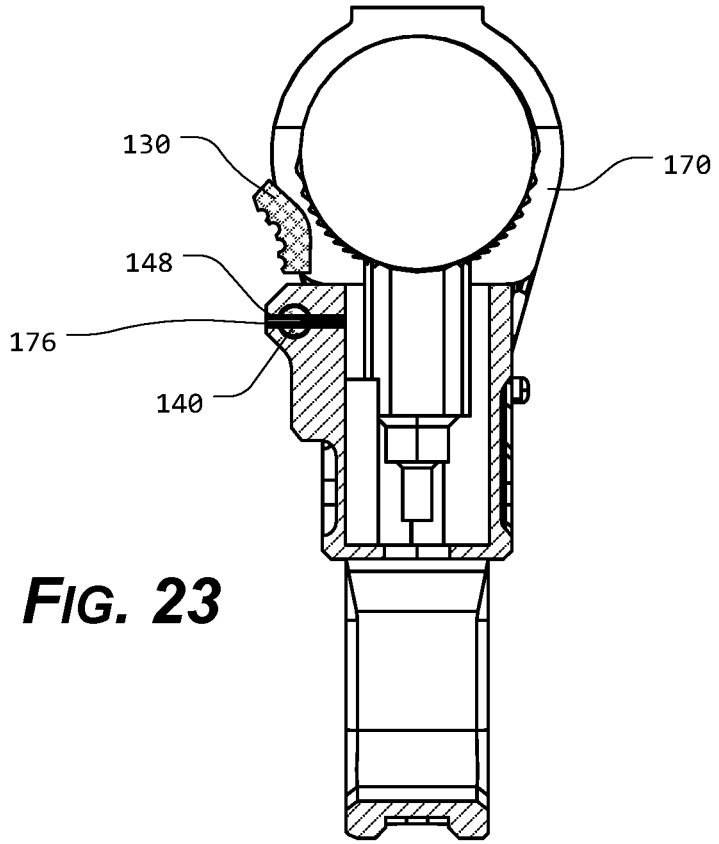
FIG. 23 illustrates front, cross-sectional view of a lower receiver with certain exemplary components of an exemplary ambidextrous bolt catch system, according to the present disclosure.
Figure 24:
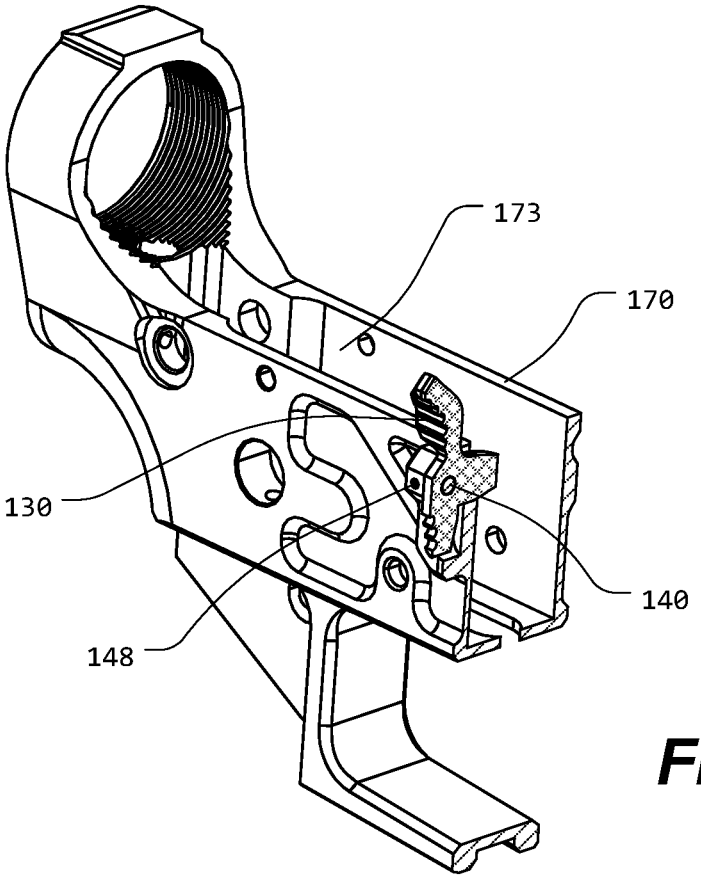
FIG. 24 illustrates an upper, right, front perspective, cross-sectional view of a lower receiver with certain exemplary components of an exemplary ambidextrous bolt catch system, according to the present disclosure.
Figure 25:
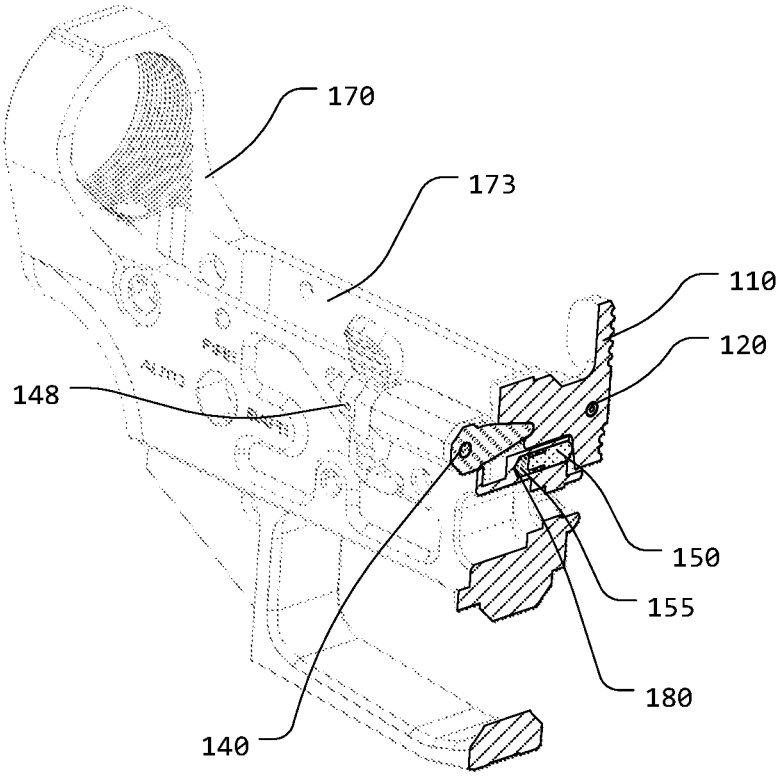
FIG. 25 illustrates an upper, right, front perspective, cross-sectional view of a lower receiver with certain exemplary components of an exemplary ambidextrous bolt catch system, according to the present disclosure.
Figure 26:
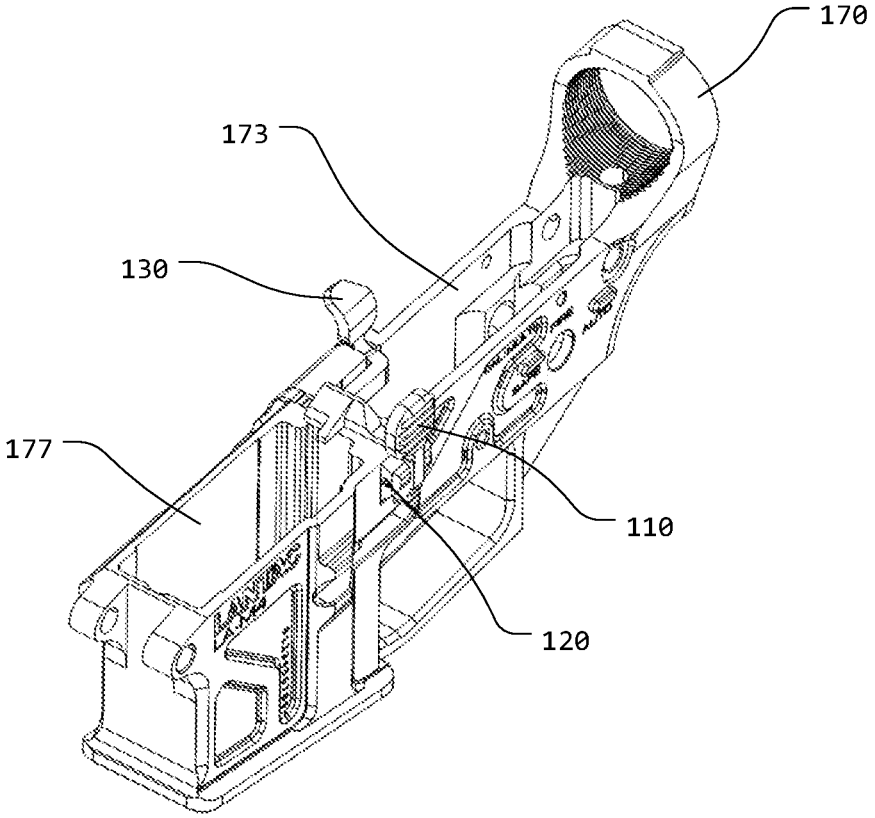
FIG. 26 illustrates an upper, left, front perspective view of a lower receiver with certain exemplary components of an exemplary ambidextrous bolt catch system, according to the present disclosure.
Figure 27:
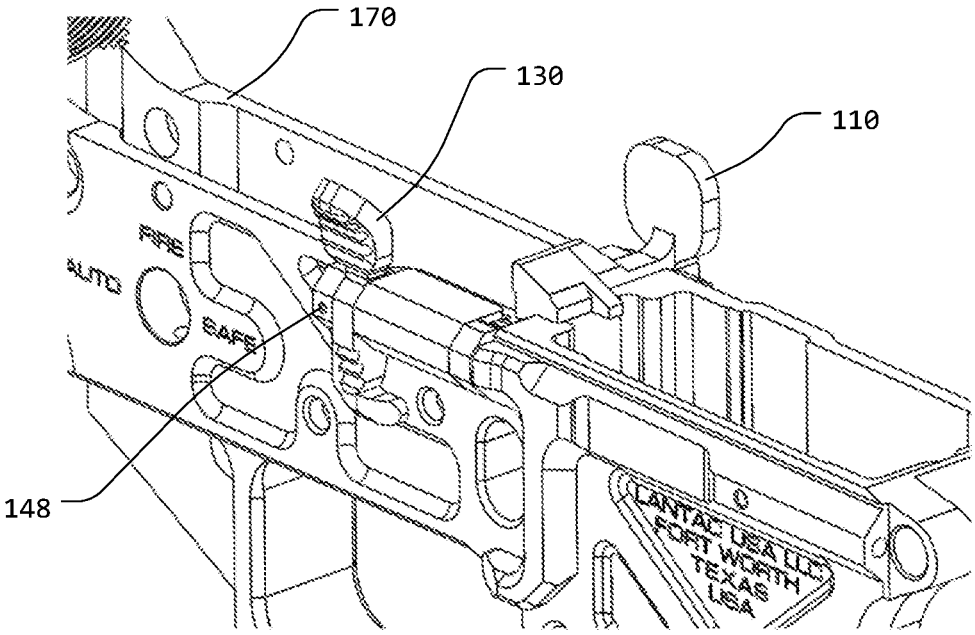
FIG. 27 illustrates an upper, right, front perspective view of a portion of a lower receiver with certain exemplary components of an exemplary ambidextrous bolt catch system, according to the present disclosure.
Figure 28:
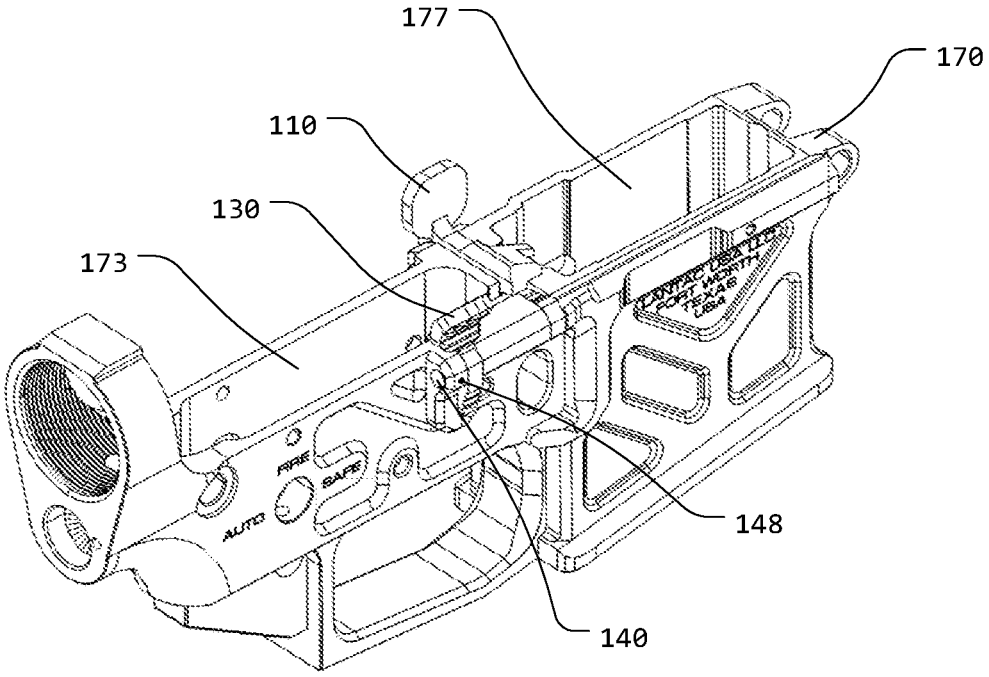
FIG. 28 illustrates an upper, right, rear perspective view of a portion of a lower receiver with certain exemplary components of an exemplary ambidextrous bolt catch system, according to the present disclosure.
Figure 29:
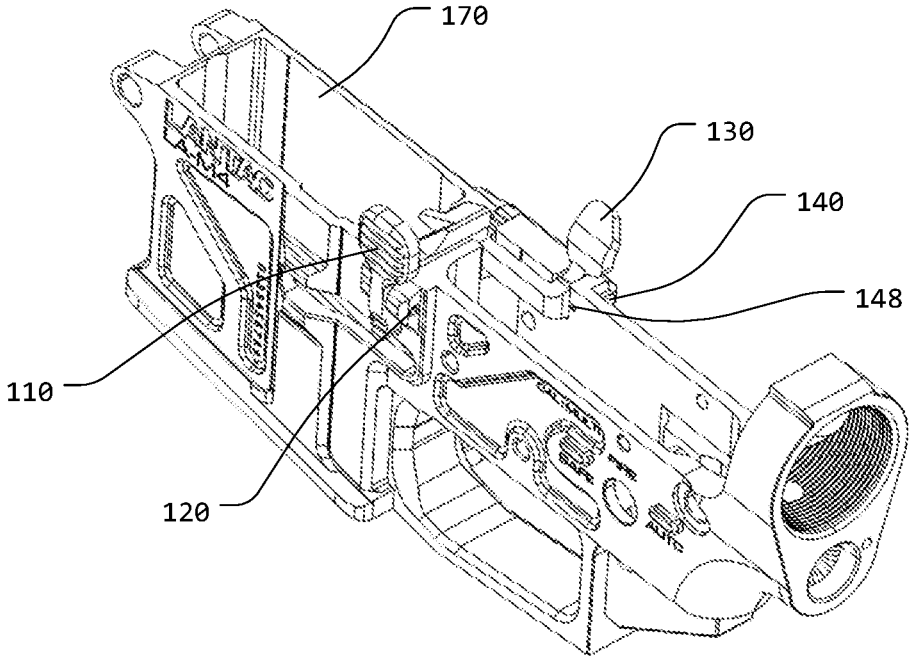
FIG. 29 illustrates an upper, left, rear perspective view of a portion of a lower receiver with certain exemplary components of an exemplary ambidextrous bolt catch system, according to the present disclosure.
Figure 30:
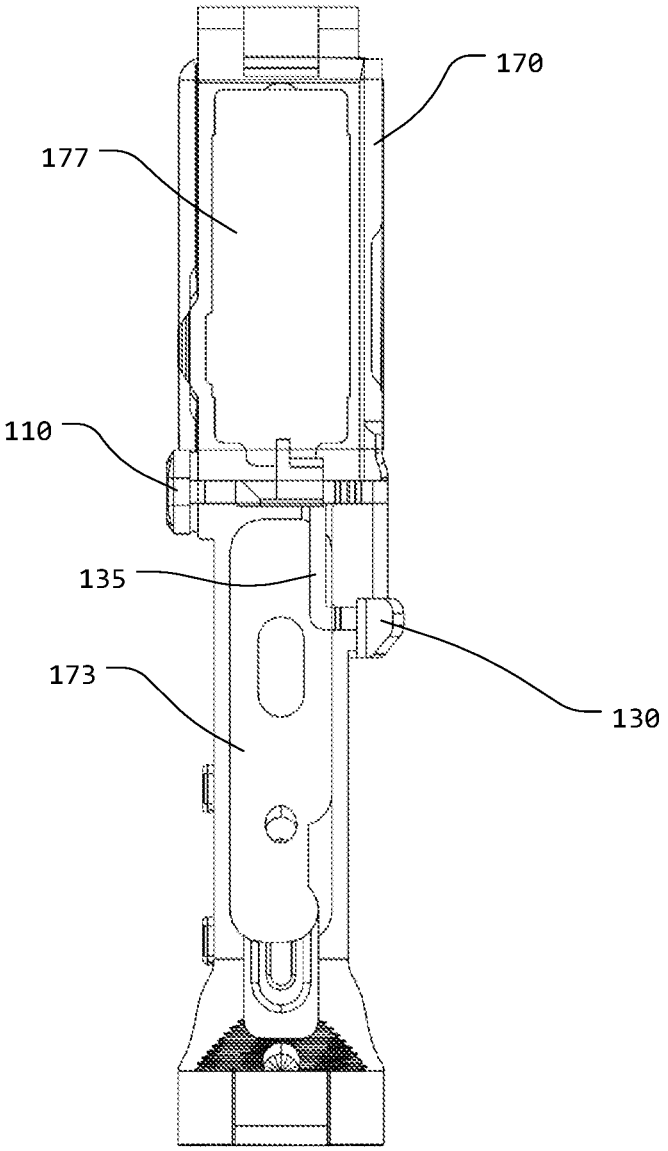
FIG. 30 illustrates a top view of a portion of a lower receiver with certain exemplary components of an exemplary ambidextrous bolt catch system, according to the present disclosure.

As illustrated most clearly in FIGS. 18-20, the lower receiver 170 to be used in conjunction with the ambidextrous bolt catch system 100 comprises at least some of a trigger guard 171, a trigger guard aperture 172, a receiver bolt catch recess 178, a receiver bolt release recess 174, a receiver magazine well 177, and a receiver fire control pocket 173.

As illustrated most clearly in FIGS. 2-7, the bolt catch 110 comprises at least some of an upper bolt catch button 112, a lower bolt catch button 114, a bolt catch pivot aperture 113, a bolt engagement projection 115, a magazine biasing projection 116, and a bolt catch recess 118. It should be appreciated that the upper bolt catch button 112, the lower bolt catch button 114, the bolt catch pivot aperture 113, the bolt engagement projection 115, and the magazine biasing projection 116 operate similarly to corresponding elements of known bolt catches.

However, the bolt catch 110 further comprises a bolt catch recess 118. The bolt catch recess 118 extends into a portion of the bolt catch 110, below the bolt engagement projection 115. The bolt catch recess 118 is formed so as to matingly correspond to at least a portion of the bolt release projection 138 of the bolt release lever 130. In this manner, the bolt catch recess 118 is able to receive at least a portion of a bolt release projection 138 of the bolt release lever 130 at least partially therein.

A portion of the bolt catch 110 includes a first side facing generally outward from the lower receiver 170, away from the fire control pocket formed within the lower receiver 170, and a second side facing toward the fire control pocket formed within the lower receiver 170. The bolt catch 110 comprises at least some of an upper bolt catch button 112 and a lower bolt catch button 114.

In various exemplary embodiments, a portion of the first side of the upper bolt catch button 112 optionally includes a textured portion. In this manner, the upper bolt catch button 112 may be distinguished tactilely from other portions of the bolt catch 110 or the lower receiver 170. Similarly, a portion of the first side of the lower bolt catch button 114 may optionally include a textured portion. In this manner, the lower bolt catch button 114 may be distinguished tactilely from other portions of the bolt catch 110 or the lower receiver 170.

In various exemplary, non-limiting embodiments, bolt catch 110 is rotatably connected to the lower receiver 170, approximately between the upper bolt catch button 112 and the lower bolt catch button 114, via a fulcrum or bolt catch pivot pin 120, positioned through a bolt catch pivot aperture 113.

In various embodiments the bolt catch 110 may be able to rotate about the bolt catch pivot pin 120 by an angle of up to 3 degrees, up to 5 degrees, up to 10 degrees, up to 15 degrees, or up to 20 degrees.

Figure 32:
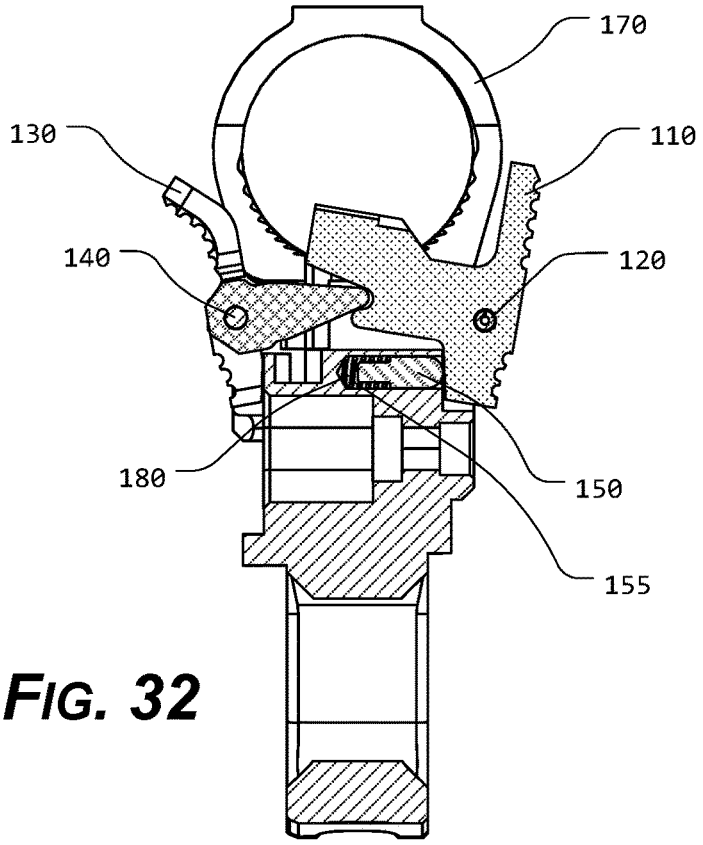
FIG. 32 illustrates a front, cross-sectional view of a portion of a lower receiver with certain exemplary components of an exemplary ambidextrous bolt catch system, wherein the bolt catch is in an engaged position, according to the present disclosure.

The bolt catch 110 is pivotable between an engaged position and a disengaged position. In the engaged position, as illustrated in FIG. 32, the lower bolt catch button 114 is urged towards the lower receiver 170 and the bolt engagement projection 115 extends upward from the lower receiver 170, in front of the face of a bolt carrier (when the bolt carrier is in a rearward position) and engages the bolt face to maintain the bolt carrier in the rearward position.

Figure 31:
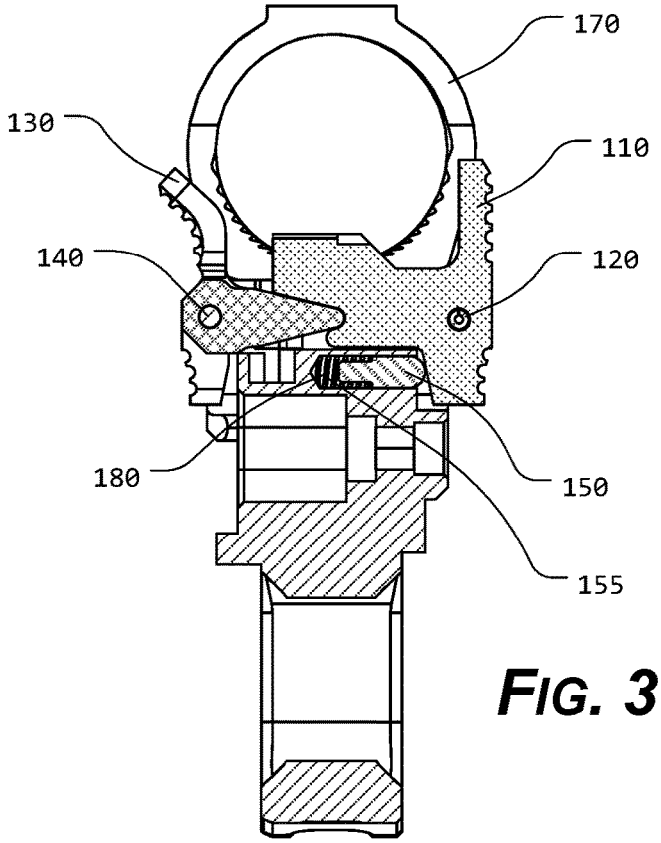
FIG. 31 illustrates a front, cross-sectional view of a portion of a lower receiver with certain exemplary components of an exemplary ambidextrous bolt catch system, wherein the bolt catch is in a disengaged position, according to the present disclosure.

In the disengaged position, as illustrated in in FIG. 31, the upper bolt catch button 112 is urged towards the lower receiver 170 and the bolt engagement projection 115 is retracted or urged downward, toward the lower receiver 170, away from the face of a bolt carrier, so as to disengage from the bolt face and allow the bolt carrier to move forward, relative to the lower receiver 170.

In various exemplary embodiments, the bolt catch 110 may be biased to the disengaged position via, for example, the spring biasing force of a detent spring 155 acting on a detent 150, which is urged against the second side of the bolt catch 110, proximate the lower bolt catch button 114. It should be appreciated that alternative biasing means, element, or mechanism may be used to urged or bias the bolt catch 110 to the disengaged position.

The magazine biasing projection 116 extends from the bolt catch 110 so as to interact with a follower in a magazine inserted into the receiver magazine well 177. In this manner, when an empty magazine is in the lower receiver 170, the magazine follower interacts with the magazine biasing projection 116 to pivot the bolt catch 110 to the engaged position.

As illustrated most clearly in FIGS. 8-13, the bolt release lever 130 comprises at least some of a bolt release button portion 131 (including an upper bolt release button 132, a lower bolt release button 134, and a bolt release pivot aperture 133) and a bolt release projection portion 137 (including a bolt release projection 138), and a bolt release connector bar 135.

A portion of the bolt release lever 130 includes a first side facing generally outward from the lower receiver 170, away from the fire control pocket formed within the lower receiver 170, and a second side facing toward the fire control pocket formed within the lower receiver 170.

The bolt release button portion 131 comprises at least some of an upper bolt release button 132 and a lower bolt release button 134. In various exemplary embodiments, a portion of the first side of the upper bolt release button 132 optionally includes a textured portion. In this manner, the upper bolt release button 132 may be distinguished tactilely from other portions of the bolt release lever 130 or the lower receiver 170. Similarly, a portion of the first side of the lower bolt release button 134 may optionally include a textured portion. In this manner, the lower bolt release button 134 may be distinguished tactilely from other portions of the bolt release lever 130 or the lower receiver 170. In various exemplary embodiments, a portion of the upper bolt release button 132 comprises a curved or beveled surface having surface preparations and/or textures so as to provide gripping surface areas.

A bolt release pivot aperture 133 is formed through the bolt release button portion 131, approximately between the upper bolt release button 132 and the lower bolt release button 134.

The bolt release projection portion 137 is formed spaced apart from the bolt release button portion 131. The bolt release projection portion 137 includes a bolt release projection 138 that extends from the bolt release projection portion 137. The bolt release projection 138 is formed so as to matingly correspond to at least a portion of the bolt catch recess 118 of the bolt catch 110. In this manner, the bolt catch recess 118 is able to receive at least a portion of a bolt release projection 138 of the bolt release lever 130 at least partially therein.

A bolt release pivot aperture 133 is formed through the bolt release button portion 131. The bolt release pivot aperture 133 of the bolt release projection portion 137 is aligned with the bolt release pivot aperture 133 of the bolt release button portion 131. In this manner, the pivot pin body 143 of the bolt release lever pivot pin 140 is able to be positioned through both of the aligned bolt release pivot apertures 133 of the bolt release lever 130.

In various embodiments the bolt release lever 130 may be able to rotate about the bolt release lever pivot pin 140 by an angle of up to 3 degrees, up to 5 degrees, up to 10 degrees, up to 15 degrees, or up to 20 degrees.

A bolt release connector bar 135 attaches the bolt release projection portion 137 to the bolt release button portion 131. The bolt release connector bar 135 is substantially L-shaped, so as to extend from the bolt release projection portion 137 and the bolt release button portion 131. The bolt release connector bar 135 extends from the bolt release button portion 131 so as to allow the bolt release connector bar 135 to extend from the bolt release button portion 131 into the receiver file control pocket of the lower receiver 170.

When the bolt release lever 130 is rotatably connected to the lower receiver 170, a portion of the bolt release connector bar 135 is positioned within a portion of the receiver bolt release recess 174 of the lower receiver 170 and the bolt release projection portion 137 is positioned within a portion of the receiver bolt catch recess 178. In this manner, the bolt release connector bar 135 extends within at least a portion of the receiver fire control pocket 173.

The bolt release lever pivot pin 140 extends from a pivot pin head 141 to a pivot pin shoulder 142. A pivot pin body 143 extends from the pivot pin shoulder 142 to a terminating end. The pivot pin body 143 has a reduced outer diameter when compared to an outer diameter of the pivot pin head 141. In various exemplary embodiments, a pivot pin retaining pin aperture 144 is formed through a portion of the pivot pin head 141. The pivot pin retaining pin aperture 144 is formed so as to receive at least a portion of a pivot pin retaining pin 148 therethrough.

Once appropriately positioned, the bolt release lever pivot pin 140 is positioned within the receiver pivot pin apertures 175 of the lower receiver 170. Once appropriately positioned, the pivot pin body 143 extends through the aligned receiver pivot pin apertures 175 and the aligned bolt release pivot apertures 133. Once positioned, the pivot pin head 141 is received within at least a portion of a receiver pivot pin aperture 175. In various exemplary embodiments, the pivot pin retaining pin aperture 144 of the pivot pin head 141 is aligned with the receiver retaining pin aperture 176 of the lower receiver 170 and a pivot pin retaining pin 148 is positioned through at least a portion of the aligned receiver retaining pin aperture 176 and pivot pin retaining pin aperture 144 to maintain the bolt release lever pivot pin 140 in a desired position relative to the lower receiver 170.

In certain exemplary embodiments, the receiver pivot pin aperture 175 extends into a portion of the lower receiver 170, such that a terminating end of the pivot pin body 143 is captured within a portion of the lower receiver 170.

The bolt release lever 130 is pivotable between an engaged position and a disengaged position. In the engaged position, as illustrated in FIG. 32, the lower bolt release button 134 is urged towards the lower receiver 170 and the bolt release projection 138 interacts with at least a portion of the bolt catch recess 118 to urge the bolt catch 110 to the engaged position.

When the bolt release lever 130 is pivotable to the disengaged position, as illustrated in in FIG. 31, the upper bolt release button 132 is urged towards the lower receiver 170 and the bolt release projection 138 interacts with at least a portion of the bolt catch recess 118 to urge the bolt catch 110 to the disengaged position.

In various exemplary embodiments, the bolt release lever 130 may be biased to the disengaged position via the interaction of the bolt release projection 138 with the bolt catch recess 118. It should be appreciated that alternative biasing means, element, or mechanism may be used to urged or bias the bolt release lever 130 to the disengaged position.

In various exemplary embodiments, various components of the ambidextrous bolt catch system 100 are substantially rigid and are formed of metal. Alternate materials of construction of the various components of the ambidextrous bolt catch system 100 may include one or more of the following: wood, steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous bolt catch system 100 is a design choice based on the desired appearance and functionality of the ambidextrous bolt catch system 100.

It should be appreciated that certain elements of the ambidextrous bolt catch system 100 may be formed as an integral unit. Alternatively, suitable materials can be used and sections or elements made independently and attached or coupled together, such as by adhesives, welding, screws, rivets, pins, or other fasteners, to form the various elements of the ambidextrous bolt catch system 100.

FIGS. 1-20 most clearly illustrate various exemplary components of the ambidextrous bolt catch system 100, while FIGS. 21-32 most clearly illustrate the ambidextrous bolt catch system 100 installed within the ambidextrous lower receiver 170. During installation, the bolt release lever 130 is positioned relative to the lower receiver 170, such that a portion of the bolt release connector bar 135 (extending from the bolt release button portion 131) is positioned within a portion of the receiver bolt release recess 174 of the lower receiver 170 and a portion of the bolt release projection portion 137 is positioned within a portion of the receiver bolt catch recess 178. In this manner, the bolt release connector bar 135 extends within at least a portion of the receiver fire control pocket 173.

Once appropriately positioned, a portion of the bolt release lever pivot pin 140 is positioned through the aligned receiver pivot pin apertures 175 of the lower receiver 170 and bolt release pivot apertures 133 of the bolt release lever 130. Once positioned, the pivot pin head 141 is received within at least a portion of a receiver pivot pin aperture 175. In various exemplary embodiments, the pivot pin retaining pin aperture 144 of the pivot pin head 141 is aligned with the receiver retaining pin aperture 176 of the lower receiver 170 and a pivot pin retaining pin 148 is positioned through at least a portion of the aligned receiver retaining pin aperture 176 and pivot pin retaining pin aperture 144 to maintain the bolt release lever pivot pin 140 in a desired position relative to the lower receiver 170.

The detent spring 155 and detent 150 are positioned within the detent receiving recess 180 of the lower receiver 170.

The bolt catch 110 is positioned relative to the lower receiver 170, such that a portion of the second side of the lower bolt catch button 114 is positioned within a portion of the receiver bolt catch recess 178 of the lower receiver 170 and the bolt catch pivot aperture 113 is aligned with the receiver bolt catch pin apertures 179 of the lower receiver 170.

Once appropriately positioned, a portion of the bolt catch pivot pin 120 is positioned through the aligned receiver bolt catch pivot pin 120 apertures of the lower receiver 170 and bolt catch pivot aperture 113 of the bolt catch 110. Once positioned, a portion of the bolt release projection 138 extends within at least a portion of the bolt catch recess 118.

Thus, the lower receiver 170 having an ambidextrous bolt catch system 100 includes a bolt release lever 130 and a bolt catch 110 that are each pivotable, relative to the lower receiver 170, between and engaged position and a disengaged position. Rotational movement of the bolt release lever 130 results in rotational movement of the bolt catch 110 and rotational movement of the bolt catch 110 results in rotational movement of the bolt release lever 130.

It should be appreciated that a more detailed explanation of the components of the lower receiver 170 and certain other items and/or techniques necessary for the implementation and/or operation of the various components of the AR-15 platform are not provided herein because such background information will be known to one of ordinary skill in the art. Therefore, it is believed that the level of description provided herein is sufficient to enable one of ordinary skill in the art to understand and implement the system as described.

During use, when the lower bolt release button 134 of the bolt release lever 130 is urged towards the lower receiver 170, interaction between the bolt release projection 138 and the bolt catch recess 118 urge the bolt catch 110 to the engaged position. When the upper bolt release button 132 of the bolt release lever 130 is urged towards the lower receiver 170, interaction between the bolt release projection 138 in the bolt catch recess 118 urge the bolt catch 110 to the disengaged position.

Alternatively, when the lower bolt catch button 114 of the bolt catch 110 is urged towards the lower receiver 170, interaction between the bolt catch recess 118 and the bolt release projection 138 urged the bolt release lever 130 to the engaged position. When the upper bolt catch button 112 of the bolt catch 110 is urged towards the lower receiver 170, interaction between the bolt catch recess 118 and the bolt release projection 138 urged the bolt release lever 130 to the disengaged position.

Since the bolt release lever 130 can be accessed from the right side of the lower receiver 170 and the bolt catch 110 can be accessed from the left side of the lower receiver 170, the present disclosure provides a truly ambidextrous bolt catch system 100.

While the presently disclosed systems, methods, and/or apparatuses have been described in conjunction with the exemplary embodiments outlined above, the foregoing description of exemplary embodiments, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An ambidextrous bolt catch system, comprising:

a bolt release lever having a bolt release button portion, a bolt release connector bar, and a bolt release projection portion, wherein said bolt release button portion is spaced apart from said bolt release projection portion, via said bolt release connector bar, wherein said bolt release button portion, said bolt release connector bar, and said bolt release projection portion are formed as a unitary body, wherein a bolt release pivot aperture is formed through said bolt release lever so as to allow said bolt release lever to be rotatably attached or coupled to a lower receiver of a firearm, via a bolt release pivot pin positioned through said bolt release pivot aperture;

a bolt catch having a bolt catch recess, wherein at least a portion of said bolt release projection portion is received within at least a portion of said bolt catch recess, and wherein rotational movement of said bolt release lever produces rotational movement of said bolt catch, via interaction of at least a portion of said bolt release projection portion and at least a portion of said bolt catch recess; and wherein said bolt release lever is positioned within a portion of a lower receiver such that at least a portion of said bolt release connector bar extends within at least a portion of a receiver fire control pocket of said lower receiver.

2. The ambidextrous bolt catch system of claim 1, wherein said bolt catch is spring biased to said disengaged position.

3. An ambidextrous bolt catch system, comprising:

a bolt catch, wherein a bolt catch recess is formed in a portion of said bolt catch, wherein a bolt catch pivot aperture is formed through said bolt catch, and wherein said bolt catch is at least partially rotatable, about said bolt catch pivot aperture, between an engaged position and a disengaged position;

a bolt release lever having a bolt release button portion, a bolt release connector bar, and a bolt release projection portion, wherein a bolt release pivot aperture is formed through said bolt release lever so as to allow said bolt release lever to be rotatably attached or coupled to a lower receiver of a firearm, via a bolt release pivot pin positioned through said bolt release pivot aperture, wherein said bolt release button portion is spaced apart from said bolt release projection portion, via said bolt release connector bar, wherein said bolt release button portion, said bolt release connector bar, and said a bolt release projection portion are formed as a one-piece article, wherein said bolt release projection portion includes a bolt release projection that extends from a portion of said bolt release projection portion, wherein said bolt release projection is formed so as to be at least partially received within at least a portion of said bolt catch recess of said bolt catch, wherein said bolt release lever is at least partially rotatable, about said bolt release pivot aperture, between an engaged position and a disengaged position, and wherein at least a portion of said bolt release projection interacts with at least a portion of said bolt catch recess such that rotational movement of said bolt release lever produces rotational movement of said bolt catch; and wherein said bolt release lever is positioned within a portion of a lower receiver such that at least a portion of said bolt release connector bar extends within at least a portion of a receiver fire control pocket of said lower receiver.

4. The ambidextrous bolt catch system of claim 3, wherein said bolt catch recess extends into said portion of said bolt catch, below a bolt engagement projection of said bolt catch.

5. The ambidextrous bolt catch system of claim 3, wherein said bolt catch comprises an upper bolt catch button and a lower bolt catch button and wherein said bolt catch pivot aperture is formed between said upper bolt catch button and said lower bolt catch button.

6. The ambidextrous bolt catch system of claim 3, wherein said bolt catch comprises an upper bolt catch button and a lower bolt catch button and wherein said bolt catch pivot aperture is formed between said upper bolt catch button and said lower bolt catch button, wherein said bolt catch is attached or coupled to a lower receiver of a firearm, via a bolt catch pivot pin positioned through said bolt catch pivot aperture, and wherein said bolt catch is at least partially rotatable, about said bolt catch pivot pin, between an engaged position wherein said lower bolt catch button is urged towards a lower receiver and a disengaged position wherein said upper bolt catch button is urged towards said lower receiver.

7. The ambidextrous bolt catch system of claim 3, wherein said bolt catch is biased to said disengaged position.

8. The ambidextrous bolt catch system of claim 3, wherein said bolt release lever is formed of an integral portion of material.

9. The ambidextrous bolt catch system of claim 3, wherein said bolt release lever comprises an upper bolt release button and a lower bolt release button and wherein said bolt release pivot aperture is formed between said upper bolt release button and said lower bolt release button.

10. The ambidextrous bolt catch system of claim 3, wherein said bolt release pivot aperture is formed through said bolt release button portion and said bolt release projection portion.

11. The ambidextrous bolt catch system of claim 3, wherein said bolt release lever comprises an upper bolt release button and a lower bolt release button and wherein said bolt release pivot aperture is formed between said upper bolt release button and said lower bolt release button, and wherein said bolt release lever is at least partially rotatable, about said bolt release lever pivot pin, between an engaged position wherein said lower bolt release button is urged towards a lower receiver and said bolt release projection interacts with at least a portion of said bolt catch recess to urge said bolt catch to said engaged position and a disengaged position wherein said upper bolt release button is urged towards said lower receiver and said bolt release projection interacts with at least a portion of said bolt catch recess to urge said bolt catch to said disengaged position.

12. The ambidextrous bolt catch system of claim 11, wherein said bolt release lever pivot pin includes a pivot pin head and a pivot pin body, wherein said bolt release lever pivot pin extends from said pivot pin head to a pivot pin shoulder and said pivot pin body extends from said pivot pin shoulder to a terminating end, and wherein said pivot pin body has a reduced outer diameter when compared to an outer diameter of said pivot pin head.

13. The ambidextrous bolt catch system of claim 3, wherein said ambidextrous bolt catch system is positionable within a portion of a lower receiver of a firearm.

14. An ambidextrous bolt catch system, comprising:

a bolt catch, wherein a bolt catch recess extends into a portion of said bolt catch, wherein a bolt catch pivot aperture is formed through said bolt catch, and wherein said bolt catch is at least partially rotatable, about said bolt catch pivot aperture;

a bolt release lever having a bolt release button portion, a bolt release connector bar, and a bolt release projection portion, wherein said bolt release button portion is spaced apart from said bolt release projection portion, via said bolt release connector bar, wherein said bolt release button portion, said bolt release connector bar, and said bolt release projection portion are formed as an integral unit, wherein a bolt release pivot aperture is formed through said bolt release lever, wherein said bolt release projection portion includes a bolt release projection that extends from a portion of said bolt release projection portion, wherein said bolt release projection is formed so as to be at least partially received within at least a portion of said bolt catch recess of said bolt catch, wherein said bolt release lever is rotatably attachable to a lower receiver via said bolt release pivot aperture, wherein said bolt release lever is at least partially rotatable, about said bolt release pivot aperture, and wherein at least a portion of said bolt release projection interacts with at least a portion of said bolt catch recess such that rotational movement of said bolt release lever produces rotational movement of said bolt catch; and wherein said bolt release lever is positioned within a portion of a lower receiver such that at least a portion of said bolt release connector bar extends within at least a portion of a receiver fire control pocket of said lower receiver.

15. The ambidextrous bolt catch system of claim 14, wherein said bolt catch comprises an upper bolt catch button and a lower bolt catch button and wherein said bolt catch pivot aperture is formed between said upper bolt catch button and said lower bolt catch button, wherein said bolt catch is attached or coupled to a lower receiver of a firearm, via a bolt catch pivot pin positioned through said bolt catch pivot aperture, and wherein said bolt catch is at least partially rotatable, about said bolt catch pivot pin, between an engaged position wherein said lower bolt catch button is urged towards a lower receiver and a disengaged position wherein said upper bolt catch button is urged towards said lower receiver.

16. The ambidextrous bolt catch system of claim 14, wherein said bolt release pivot aperture is formed through said bolt release button portion and said bolt release projection portion.

17. The ambidextrous bolt catch system of claim 14, wherein said bolt release lever comprises an upper bolt release button and a lower bolt release button and wherein said bolt release pivot aperture is formed between said upper bolt release button and said lower bolt release button, wherein said bolt release lever is attached or coupled to a lower receiver of a firearm, via a bolt release lever pivot pin positioned through said bolt release pivot aperture, and wherein said bolt release lever is at least partially rotatable, about said bolt release lever pivot pin, between an engaged position wherein said lower bolt release button is urged towards a lower receiver and said bolt release projection interacts with at least a portion of said bolt catch recess to urge said bolt catch to said engaged position and a disengaged position wherein said upper bolt release button is urged towards said lower receiver and said bolt release projection interacts with at least a portion of said bolt catch recess to urge said bolt catch to said disengaged position.

* * * * *